United States Patent [19]

Yabumoto et al.

[11] Patent Number: 4,548,173

[45] Date of Patent: Oct. 22, 1985

[54] SECONDARY INTAKE DEVICE

[75] Inventors: Toshio Yabumoto; Hiromu Sakaoka; Koji Nakajima, all of Saitama, Japan

[73] Assignee: Honda Giken Kogyo Kabushiki Kaisha, Tokyo, Japan

[21] Appl. No.: 569,954

[22] Filed: Jan. 11, 1984

[30] Foreign Application Priority Data

Jan. 12, 1983 [JP] Japan ..... 58-3199

[51] Int. Cl.[4] ..... F02B 33/00

[52] U.S. Cl. ..... 123/308; 123/432; 123/26; 123/198 C; 123/585; 123/73 CB

[58] Field of Search ..... 123/73 B, 73 CC, 73 CB, 123/26, 198 C, 198 P, 308, 432, 317, 585

[56] References Cited

U.S. PATENT DOCUMENTS

| | | | |
|---|---|---|---|
| 997,258 | 7/1911 | Bachle et al. | 123/73 B |
| 3,092,089 | 6/1963 | Dolza | 123/26 |
| 4,248,185 | 2/1981 | Jaulmes | 123/73 CC |
| 4,276,858 | 7/1981 | Jaulmes | 123/73 CB |
| 4,398,509 | 8/1983 | Offenstadt et al. | 123/432 |

FOREIGN PATENT DOCUMENTS

| | | | |
|---|---|---|---|
| 05318 | 1/1978 | Japan | 123/198 P |
| 55-210 | 5/1979 | Japan | 123/73 B |
| 91716 | 7/1980 | Japan | 123/198 C |

*Primary Examiner*—Ira S. Lazarus
*Assistant Examiner*—R. S. Bailey
*Attorney, Agent, or Firm*—Lyon & Lyon

[57] ABSTRACT

A four cycle internal combustion engine including a secondary intake system. The secondary intake system includes a pumping diaphragm actuated by pressure variation within the engine crankcase. The pumping diaphragm is in turn connected to the intake passage through a secondary intake passage to receive and expel air/fuel mixture toward the intake valving at appropriate intervals. A control valve control communication between the crankcase and the pumping diaphragm to restrict or allow actuation of the pumping diaphragm. An outlet also extends from the system to vent the crankcase at appropriate intervals.

7 Claims, 11 Drawing Figures

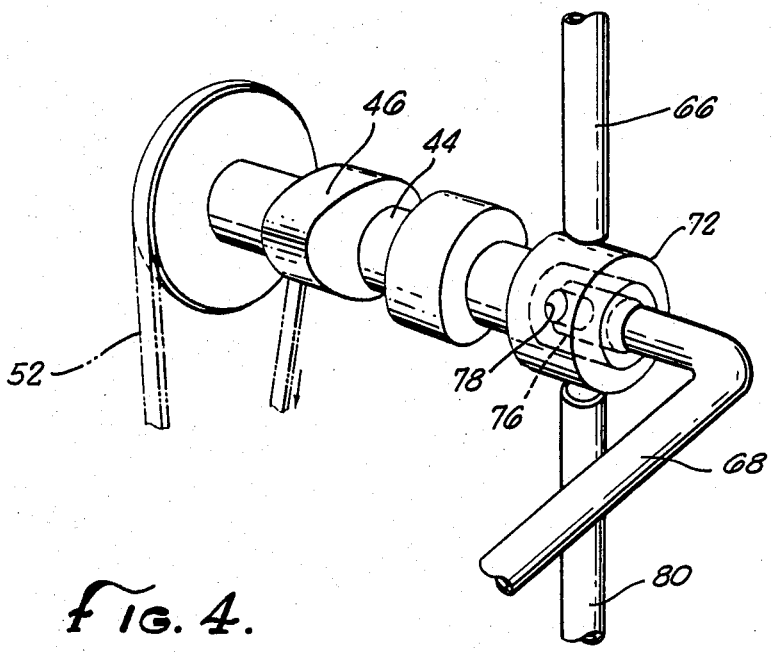
FIG. 4.
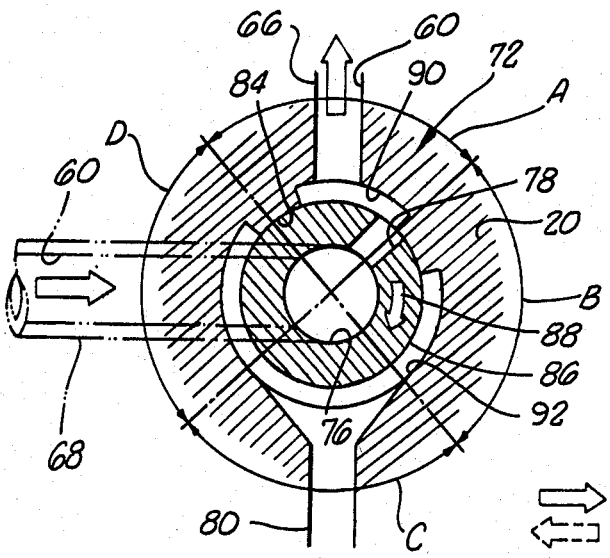
FIG. 5.
FIG. 6.
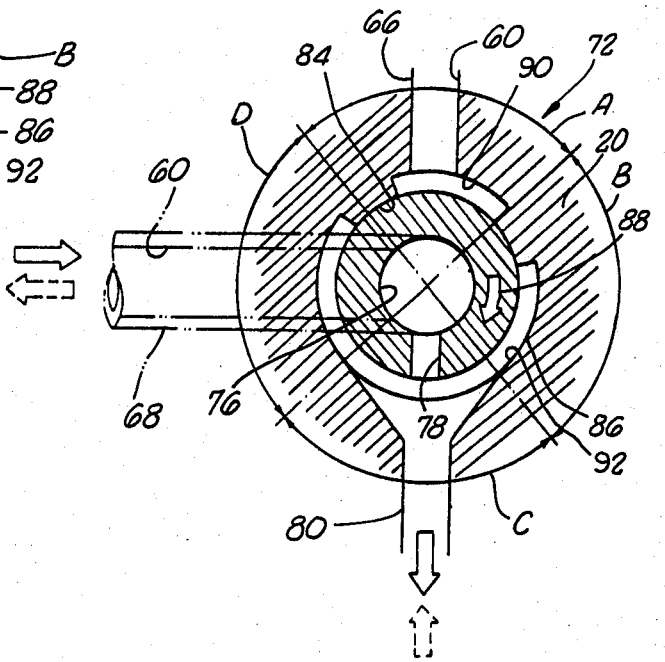

FIG. 8.
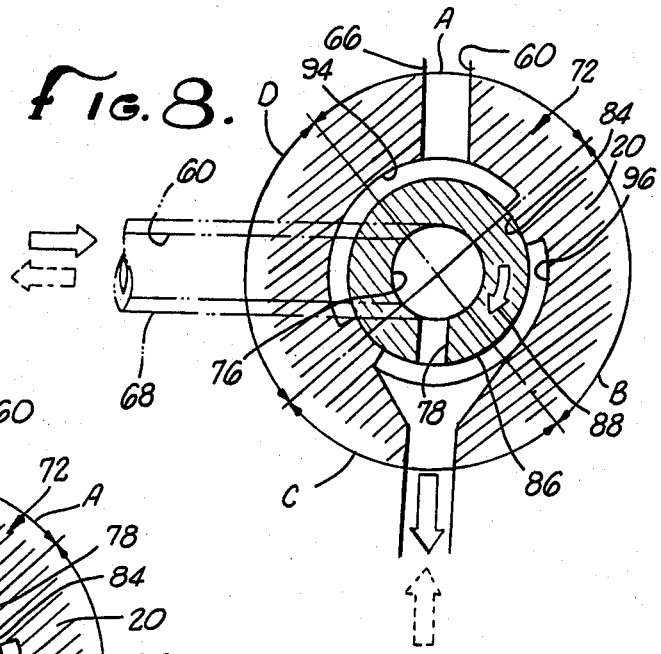
FIG. 7.
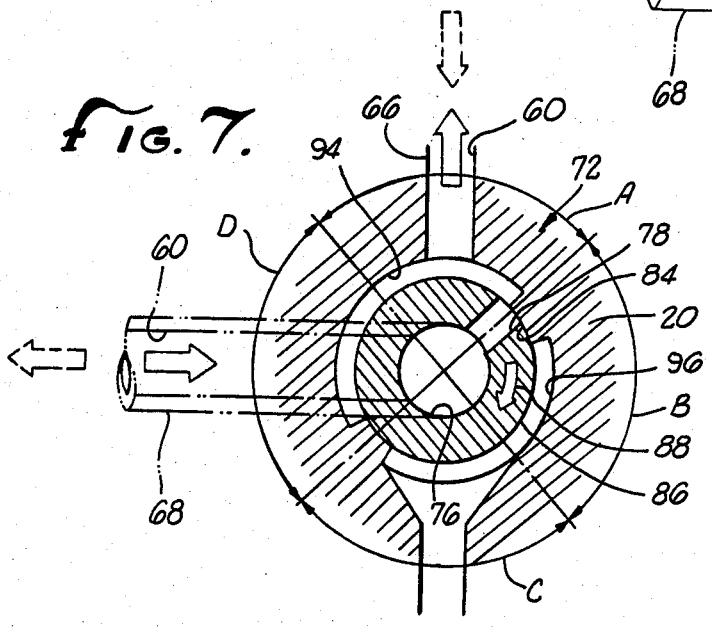
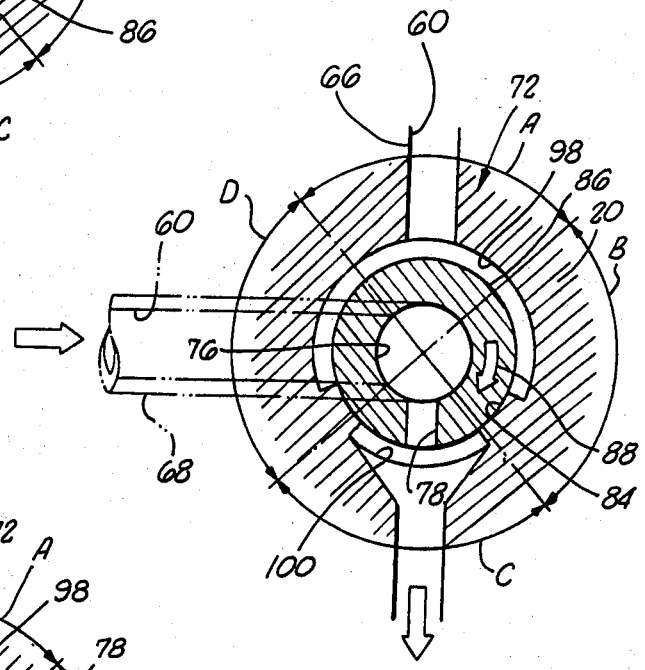
FIG. 10.
FIG. 9.
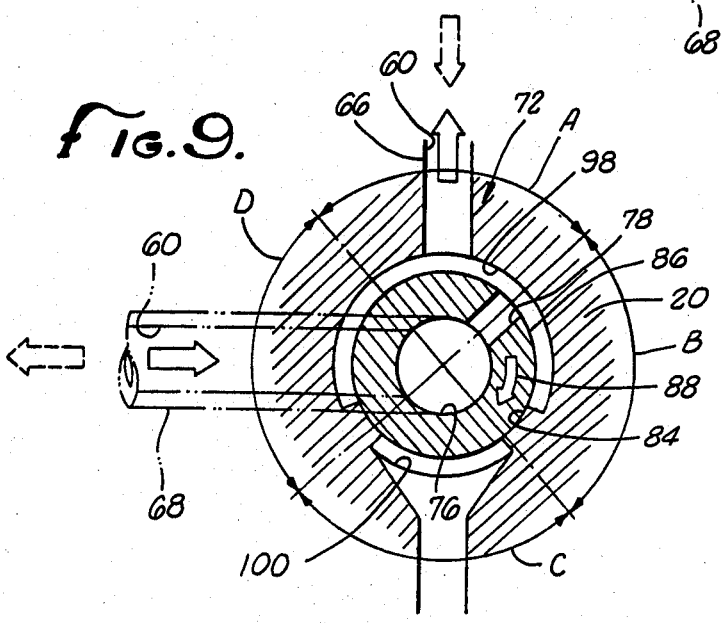

SECONDARY INTAKE DEVICE

BACKGROUND OF THE INVENTION

The field of the present invention is devices for augmenting intake to an internal combustion engine.

A myriad of devices have been developed for augmenting intake volume, conditioning intake flow, improving mixture and the like. Once such device previously employed uses the variable pressure within the crankcase, resulting from movement of the piston, to increase and condition intake flow. Such secondary intake devices employ a secondary passage with one end open to the intake port and the other end associated with a diaphragm located within the crankcase. During the exhaust cycle, reduced pressure within the crankcase causes the diaphragm to suck air/fuel mixture into the secondary passage. During the intake cycle, the mixture is ejected into the intake passage to improve inlet efficiency.

A specific difficulty found to be associated with the foregoing device is that the overpressure within the crankcase is also developed during the power stroke. During the power stroke, the intake valving is closed and ejection of additional air/fuel mixture creates back flow and other flow currents within the intake system which may, under certain conditions, reduce rather than increase inlet efficiency.

SUMMARY OF THE INVENTION

The present invention is directed to a secondary intake system of the type employing a diaphragm pump actuated by variation in crankcase pressure. A secondary passage extends from the pump to near the intake porting. Additionally, a valve is employed to control pressure to the pump from the crankcase. The valve is arranged to be closed during the power stroke of the engine to reduce the aforementioned inefficiencies. The valve may additionally be controlled to provide a variety of other specific conditions to both the crankcase and the pump associated with the intake device.

Accordingly, it is an object of the present invention to provide an improved secondary intake device for an internal combustion engine. Other and further objects and advantages will appear hereinafter.

BRIEF DESCRIPTION OF THE DRAWINGS

FIG. 4 is an oblique view of a valve of the present invention.

FIG. 5 is a schematic illustration of a first embodiment of the valve of FIG. 4.

FIG. 6 is a schematic illustration of the valve of FIG. 5 in a different position.

FIGS. 7 and 8 illustrate a second embodiment of the valve of the present invention in two positions.

FIGS. 9 and 10 illustrate yet another embodiment of the valve of the present invention in two positions.

DETAILED DESCRIPTION OF THE PREFERRED EMBODIMENTS

Figure 1:
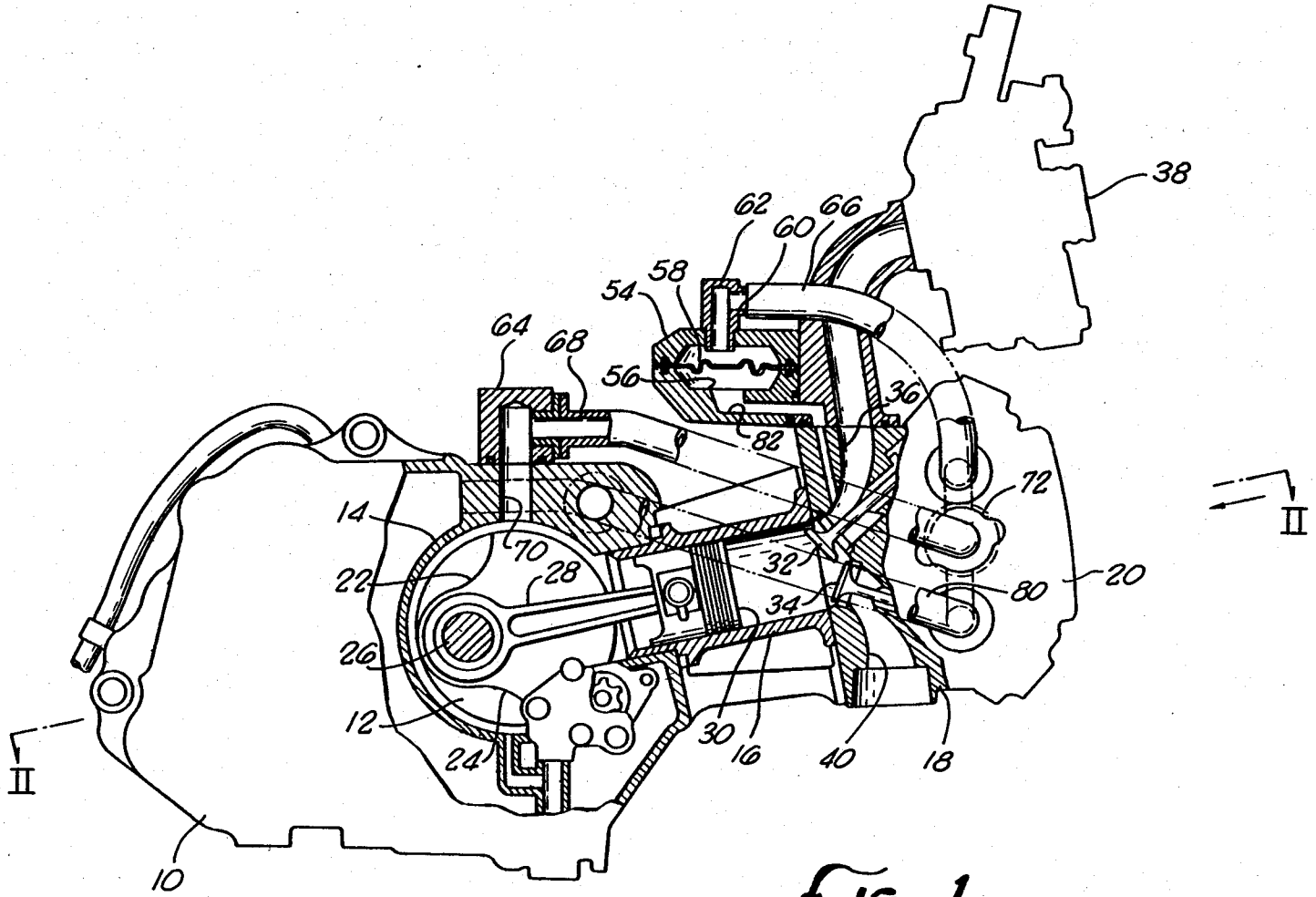
FIG. 1 is an end view of an engine employing the present invention partially broken away for clarity.

Turning in detail to the drawings, an engine is illustrated in FIG. 1. The engine includes an engine case 10 shown in this embodiment to be of sufficient extent so as to include transmission drive train components or the like. On the engine case 10 is a crankcase 12 within a portion 14 of the engine case 10. Also associated with the engine case 10 is a cylinder 16 and a cylinder head 18. A cylinder head cover 20 is positioned on the cylinder head 18 to cover the valve train.

Figure 2:
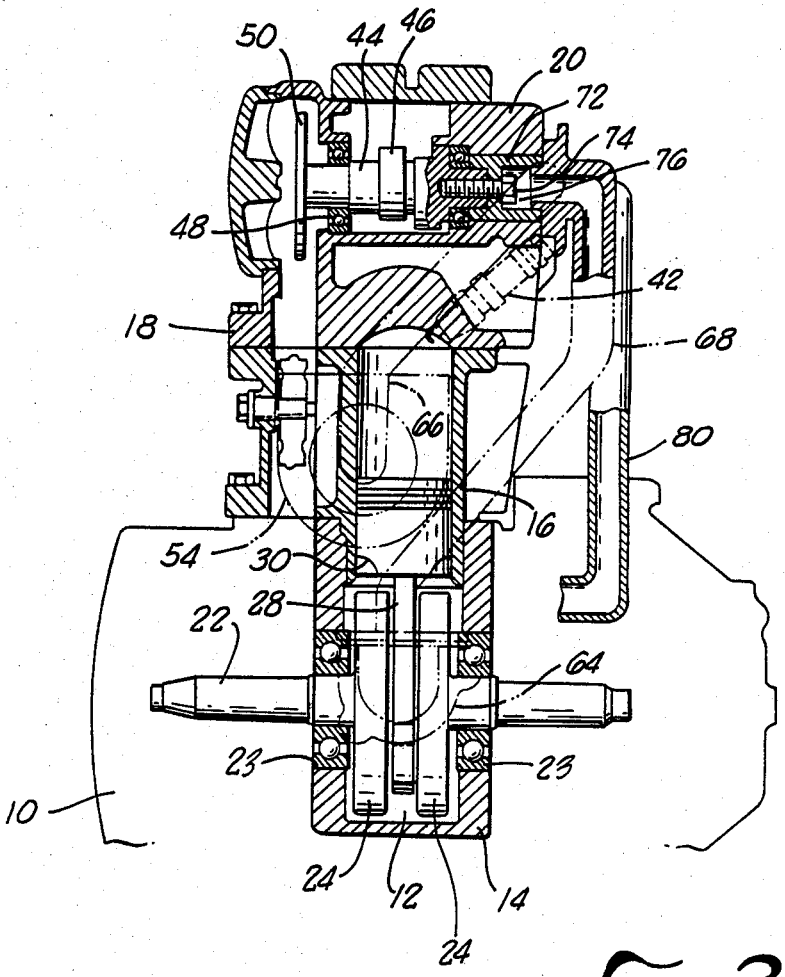
FIG. 2 is a cross-sectional view taken along line II—II of FIG. 1.

Within the crankcase 12, a crankshaft 22 is rotatably mounted in bearings 23 as can be seen in FIG. 2. The crankshaft 22 includes crank webs 24 and a crank pin 26. The crankcase 12 as defined by the portion 14 of the engine case 10 may be appropriately sized to provide the most advantageous volume for compression purposes discussed below. It is evident from an inspection of FIGS. 1 and 2 that a relatively small excess crankcase volume beyond that specifically required for location of the crankshaft is shown to be provided.

Associated with the crankshaft 22 is a connecting rod 28 to which is connected a piston 30. The piston 30 conventionally reciprocates within the cylinder 16. Intake and exhaust valving are located in the cylinder head 18 and include an intake poppet valve 32 and an exhaust poppet valve 34 both associated with conventional valve seating. An intake passage 36 extends to the intake valving from a carburetor 38. Similarly, an exhaust passage 40 extends from the exhaust valving. An ignition plug 42 extends to the combustion chamber defined by the piston 30, the cylinder 16 and the cylinder head 18.

Figure 3:
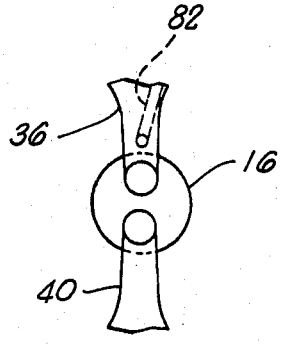
FIG. 3 is a detail plan view of the intake and exhaust passage of the engine of FIG. 1.

Looking to FIGS. 2 and 3, a valve train is illustrated as including an overhead camshaft 44 with intake and exhaust cams 46. The camshaft 44 is rotatably mounted by bearings 48. A driven pully 50 is driven by a timing belt 52 for synchronized rotation of the camshaft 44 with the crankshaft 22. Typically, the camshaft 44 rotates at one half the crankshaft speed in a four cycle engine.

Looking to the secondary intake device, a supply pump 54 is shown to be conveniently positioned adjacent the engine head 18. The supply pump 54 includes a pump chamber 56 which is divided by a flexible diaphragm 58. Through variation in pressure within the pump chamber 56 on one side of the diaphragm 58, a pumping action may be induced on the other side of the diaphragm 58.

On a first side of the diaphragm 58 in communication with the pump chamber 56 is a pump passage 60. The pump passage 60 extends from the pump chamber 56 to the crankcase 12. Constituting the pump passage is a fitting 62 associated with the supply pump 54, a fitting 64 fixed to the engine case 10 and tubes 66 and 68 connecting the fittings 62 and 64. A passageway 70 extending through the engine case 10 provides communication with the pump passage 60 through the fitting 64.

In the pump passage 60, between the tubes 66 and 68 is a control valve 72. The control valve 72 is illustrated in the preferred embodiments to be a rotary valve. In the embodiment as specifically illustrated in FIGS. 1, 2 and 4, the control valve 72 is fixed to one end of the cam shaft 44. The rotor of the control valve 72 is fixed to the end of the camshaft 44 by a fastener 74 as can best be seen in FIG. 2. The rotor includes a hollow concentric center portion 76 in communication with the portion of the pump passage 60 defined by the the tube 68. A hole 78 extends radially outwardly from the hollow portion 76 through the wall of the rotor. The tube 66 of the pump passage 60 extends into the valve cover 20 so as to come into communication with the control valve 72. As will be discussed below, the location of the rotor of the control valve 72 relative to the camshaft 44 causes appropriately timed communication between the hole 78 and the pump passage 60 associated with the tube 66. In this way, the control valve 72 controls communication between the portions of the pump passage 60 defined by the tubes 66 and 68.

Also extending from the control valve 72 is an outlet 80. The outlet 80 is shown to extend between the control valve 72 and the engine case 10. However, the outlet 80 is not in communication with the crankcase 12. The outlet 80 is also appropiately positioned relative to the control valve 72 and the tube 66 for timed communication with the portion of the pump passage 60 defined by the tube 68. Thus, the control valve permits, or controls, communication between the crankcase 12 and either the supply pump 54 or the engine case 10.

Extending from the supply pump 54 in communication with the pump chamber 56 is a secondary intake passage 82. The secondary intake passage 82 extends from the pump chamber 56 on one side of the diaphragm 58 opposite to that of the pump passage 60 to the intake passage 36. The secondary intake passage 82 intersects the intake passage 36 in front of the intake valving as can best be seen in FIG. 1.

The orientation of the secondary intake passage 82 at the intake passage 36 and the location of its intersection may be appropriately arranged to provide maximum benefit to the intake flow. For example, the flow from the secondary intake passage may be arranged to promote angular momentum, or swirl, within the combustion chamber. Inclination of the passage 82 at its intersection with the intake passage 36 is illustrated in FIGS. 1 and 3. The proximity of the intersection of the secondary intake passage 82 with the intake passage 36 also provides maximum affect on the intake flow.

The embodiment thus described provides a system whereby pressure variations within the crankcase 12 may be transmitted to the supply pump 54 to drive the diaphragm 58. The diaphragm 58 in turn causes air/fuel mixture within the intake passage 36 to be drawn into the secondary intake passage 82 and ejected therefrom. Pressure variations within the crankcase 12 may also be placed in communication with the engine case, generally at atmospheric pressure. Thus, relief of the pressure differentials relative to atmospheric pressure within the crankcase 12 is also possible.

The action of the piston 30 rociprocating within the cylinder 16 results in the pressure variations within the crankcase 12. When the piston 30 moves toward the crankcase 12 during either a power stroke or an intake stroke, pressure may be developed within the crankcase 12. When the piston moves in the other direction from the crankcase 12 during a compression or an exhaust stroke, pressure may be reduced within the crankcase 12. Such increases and reductions in pressure may be selectively transmitted to the supply pump 54 or to atmosphere through the outlet 80. The control valve 72 may be arranged to selectively provide these functions as may be most advantageous.

A plurality of embodiments for the control valve 72, so as to affect pressure variation within the crankcase 12, are illustrated in FIGS. 5 through 10. Simmilar reference numerals are applied to identical or equivalent components in each of the configurations. Each valve 72 is shown to include the cylinder cover 20 having a cylindrical cavity 84. Mounted within the cylindrical cavity 84 is a rotor 86. The rotor 86 includes the hollow portion 76 centrally positioned therein and in communication with the portion of the pump passage 60 defined by the tube 68. Extending radially outwardly from the hollow portion 76 is the hole 78. The passage 60 defined by the tube 66 extends outwardly through the cylinder head cover 20 as does the outlet 80. Each of FIGS. 5 through 10 is shown to be divided into quadrants from the central axis of the rotor 86. Quadrant A represents the intake cycle resulting from the appropriate angular orientation of the rotor 86 relative to the camshaft 44. Quadrant B represents the compression cycle, quadrant C represents the power cycle and quadrant D represents the exhaust cycle. The rotor 86 rotates in the direction indicated by the arrow 88.

Looking now to the variations between the embodiments of FIGS. 5 through 10, radial extentions of the cylindrical cavity 84 are employed to provide differing valve control. These radial extentions provide control cavities which facilitate timed communication between the hole 78 and the rotating rotor 86 and either tube 66 or outlet 80. One feature common to all of the embodiments illustrated in FIGS. 5 through 10 is that the control cavities are arranged such that communication through the pump passage 60 between the crankcase 12 and the pump chamber 56 is closed during the power stroke of the piston, quandrant C.

Looking first to the embodiment of the control valve 72 illustrated in FIGS. 5 and 6, a first control cavity 90 extends through a portion of the intake quadrant A. The hole 78 is illustrated in FIG. 5 to be in communication with the control cavity 90. During the period when the hole 78 is in communication with the control cavity 90, compression is occurring within the crankcase 12. Thus, pressure is delivered to the pump chamber 56 and intake air/fuel mixture is injected into the intake passage 36 from the secondary intake passage 82. The control cavity 90 does not extend for the full extent of the quadrant A because the piston must move downwardly a small distance to overcome the vacuum developed during the exhaust stroke of quadrant D. Leakage and the like may allow the diaphragm 58 to return to the ready position following the impulse resulting from the communication through control cavity 90.

A second control cavity 92 is associated with the control valve 72. This control cavity 92 extends through a substantial portion of quadrants B, C and D. Thus, the crankcase 12 is in communication with the outlet 80 during the compression, power and exhaust cycles. Reduction in both pressure and vacuum within the crankcase 12 during those portion of the cycles reduces the power required of the piston 30 for such work on the air within the crankcase 12. FIG. 6 illustrated the hole 78 in communication with the second control cavity 92.

Looking to FIGS. 7 and 8, a variation in control cavities is illustrated. A first control cavity 94 extends through a portion of quadrant D as well as quadrant A. Thus, the pump chamber 56 is in communication with the crankcase 12 during the exhaust stroke of the piston and the intake stroke of the piston. As a result, and as illustrated by the arrows, the pump chamber 56 experiences both a vacuum cycle and a compression cycle. The pump diaphragm 58 first acts to draw fuel intake mixture into the pump chamber 56 through the secondary intake passage 82 and then eject that mixture during the intake cycle. A control cavity 96 provides communication between the crankcase 12 and the outlet 80 during the vacuum and pressure cycles within the crankcase 12 of the compression and power strokes of the piston 30, respectively.

In the embodiment of FIGS. 9 and 10, a first control cavity 98 extends through quadrants D, A and B. Thus, the pump chamber 56 is in communication with the crankcase 12 during the portions of the engine cycle when the crankcase 12 experiences reduced pressure and also during the increased pressure intake cycle. In this way, maximum retraction of the pump diaphragm 58 is promoted as well as the ejection portion. A second control cavity 100 provides communication with the outlet 80 during the overpressure portion of the power stroke, quadrant C. This last embodiment thereby vents the crankcase 12 during the period when work must be done by the piston 30 in compressing air within the crankcase 12 during the power stroke. The piston naturally also does work to compress the air in the crankcase 12 during the intake stroke. However, the resulting compression is advantageously directed to the pump chamber 56 at that time.

Figure 11:
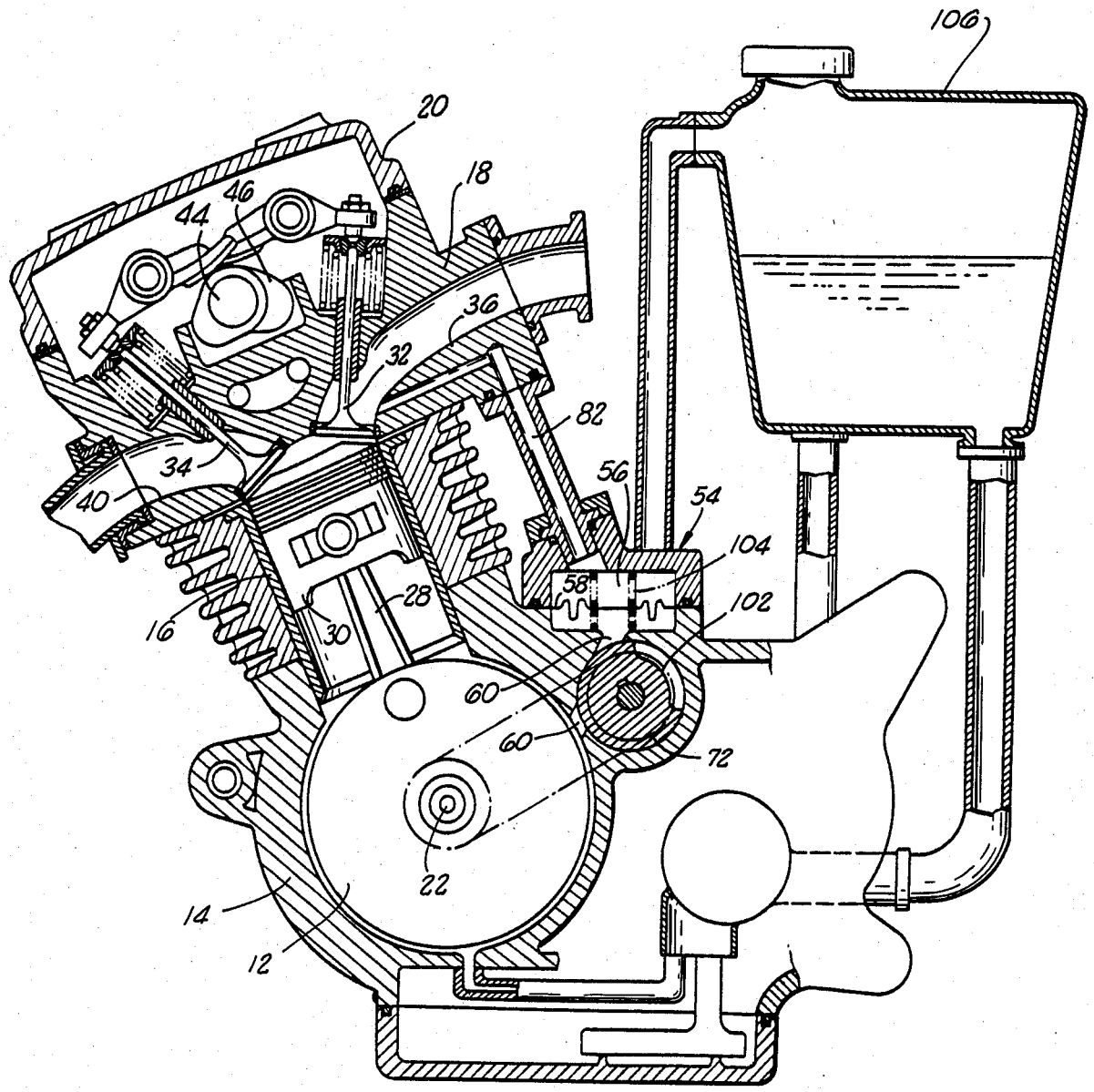
FIG. 11 illustrates a second embodiment of an engine employing a device of the present invention.

Looking then to a second embodiment for the overall system arrangement, illustrated in FIG. 11, the same reference numbers designate identical or equivalent components to that of the embodiment of FIG. 1. The earlier description is thereby incorporated with regard to FIG. 11. Of significant import with regard to the embodiment of FIG. 11 is the relocation of the control valve 72. Rather than being driven by the camshaft 44, the control valve 72 is driven by the crankshaft 22. Again, the rotor of the control valve 72 may be conveniently driven at one half the speed of the crankshaft. Also of note is the mechanism by which the control valve 72 of FIG. 11 povides communication or closure through the pump passage 60. The rotor 86 includes a control cavity 102 for communication between the crankcase 12 and the pump chamber 56 during the intake cycle. A spring 104 may be employed with the diaphragm to increase the restoring force. The outlet 80 is associated with a reservoir 106 to provide enclosed atmospheric outlet.

Thus, a plurality of embodiments of an improved secondary device are disclosed. While embodiments and application of this invention have been shown and discribed, it would be apparent to thosed skilled in the art that many more modifications are possible without departing from the inventive concept herein. The invention, therefore, is not to be restricted except by the spirit of the appended claims.

What is claimed is:

1. A secondary intake device for an internal combustion engine having an intake passage, a crankcase, intake valving and a piston, including a supply pump having a pump chamber and a diaphragm dividing said pump chamber;

a secondary intake passage extending between said pump chamber on one side of said diaphragm and the intake passage in front of the intake valving;

a pump passage extending between the crankcase and said pump chamber on the other side of said diaphragm; wherein the improvement comprises a control valve in said pump passage, said pump passage being closed by said control valve throughout the power cycle of the piston.

2. The secondary intake device of claim 1 wherein said control valve includes a rotary valve, said valve being fixed to rotate with the crankshaft.

3. The secondary intake device of claim 2 wherein said rotary valve rotates at one-half crankshaft speed.

4. The secondary intake device of claim 1 wherein said control valve is open during the intake cycle of the piston.

5. The secondary intake device of claim 1 wherein said control valve is open during the exhaust and intake cycles of the piston.

6. The secondary intake device of claim 1 wherein said control valve is open during the exhaust, intake and compression cycles of the engine.

7. The secondary intake device of claim 1 wherein the improvement further comprises said control valve including an outlet, said pump passage on a first side of said control valve being in communication with said outlet through said valve during the power cycle of the piston, said first side of said control valve being in communication with said crankcase.

* * * * *